US007074993B1

(12) United States Patent
Hsieh

(10) Patent No.: US 7,074,993 B1
(45) Date of Patent: Jul. 11, 2006

(54) INSTRUMENT SUPPORT WITH TWO ADJUSTABLE ARMS

(76) Inventor: Wu-Hong Hsieh, No. 162, Chung Shan 2nd Rd., Lu Chou City, Taipei Hsien (TW)

( * ) Notice: Subject to any disclaimer, the term of this patent is extended or adjusted under 35 U.S.C. 154(b) by 0 days.

(21) Appl. No.: 11/029,4065

(22) Filed: Jan. 6, 2005

(51) Int. Cl.
*G10D 3/00* (2006.01)

(52) U.S. Cl. ..... 84/327; 84/329

(58) Field of Classification Search ..... 84/327, 84/329; 248/443
See application file for complete search history.

(56) References Cited

U.S. PATENT DOCUMENTS 5,375,497 A * 12/1994 Pirchio et al. ..... 84/327
5,959,225 A * 9/1999 Hsu ..... 84/327
2002/0073823 A1* 6/2002 Hsieh ..... 84/327

* cited by examiner

*Primary Examiner*—Kimberly Lockett
(74) *Attorney, Agent, or Firm*—Bacon & Thomas PLLC

(57) ABSTRACT

An instrument support has a bracket provided with a first leg, a second leg, a disk and two forks. Each of the first leg and the second leg has a through hole defined in a side face of the first leg and second leg to communicate with an interior of the first leg and second leg to receive therein a spring-ball combination. A fork is movably and respectively received in the first and second legs and has an adjustable rod integrally formed with the fork and having recesses defined in a side face of the adjustable rod to correspond to the spring-ball combination so that movement of the two forks provide adaptation to thickness of different instruments.

3 Claims, 8 Drawing Sheets

INSTRUMENT SUPPORT WITH TWO ADJUSTABLE ARMS

BACKGROUND OF THE INVENTION

1. Field of the Invention

The present invention relates to an instrument support, and more particularly to an instrument support with two adjustable arms to adapt to instruments of different thickness.

2. Description of Related Art

An instrument support is to provide a specific instrument, such as a guitar or the like, a foundation on which to stand the instrument especially when the instrument can not stand by itself. With reference to FIG. 5, it is noted that a conventional instrument support has a first leg (10') and a second leg (20') jointing together with the first leg (10') via a disk (12'). That is, a first end of the first leg (10') is securely and fixedly connected to the disk (12') and a first end of the second leg (20') is pivotally connected to the disk (12'). The second leg (20') has a handle (26') pivotally connected to the second leg (20') and has an extension (22') formed on a distal end of the handle (26') to alternatively correspond to positioning holes (14') defined in the disk (12') such that when the handle (26') is pivoted, the extension (22') is removed from the restriction of the positioning hole (14') in which the extension (22') is originally located and the extension (22') is able to be relocated at a different positioning hole (14') to adjust the angle between the first leg (10') and the second leg (20'). What is more important is that the first leg (10') and the second leg (20') respectively have a base (11',21') to support the first and second legs (10'20') on a surface and an arm (13',15') securely formed on a side face of the first and second legs (10',20'). Therefore, when the conventional instrument support is placed on top of a surface, the instrument is able to be supported by the two arms (13',15') and the disk (12'). Although the instrument support does provide the required service to the instrument, there is no room for thickness change of the instrument. That is, when the instrument thickness using the instrument support is changed, e.g., from an electric guitar to an acoustic guitar, the two arms (13',15') can not provide the required supporting function to the new instrument. That is, the support from the two arms (13',15') is limited to a certain instrument with a specific thickness. With reference to FIG. 6, a different conventional instrument support is shown and has two arms (13A, 15A). Although the configuration of the two arms (13A, 15A) is different from that shown in FIG. 5, this instrument support still suffers from the same drawback as that of the instrument support shown in FIG. 5.

To overcome the shortcomings, the present invention tends to provide an improved instrument support to mitigate the aforementioned problems.

SUMMARY OF THE INVENTION

The primary objective of the present invention is to provide an improved instrument support having two arms movably connected to the first and second legs such that the two arms are able to support instruments with different thickness.

Other objects, advantages and novel features of the invention will become more apparent from the following detailed description when taken in conjunction with the accompanying drawings.

DETAILED DESCRIPTION OF THE PREFERRED EMBODIMENT

Figure 1A:
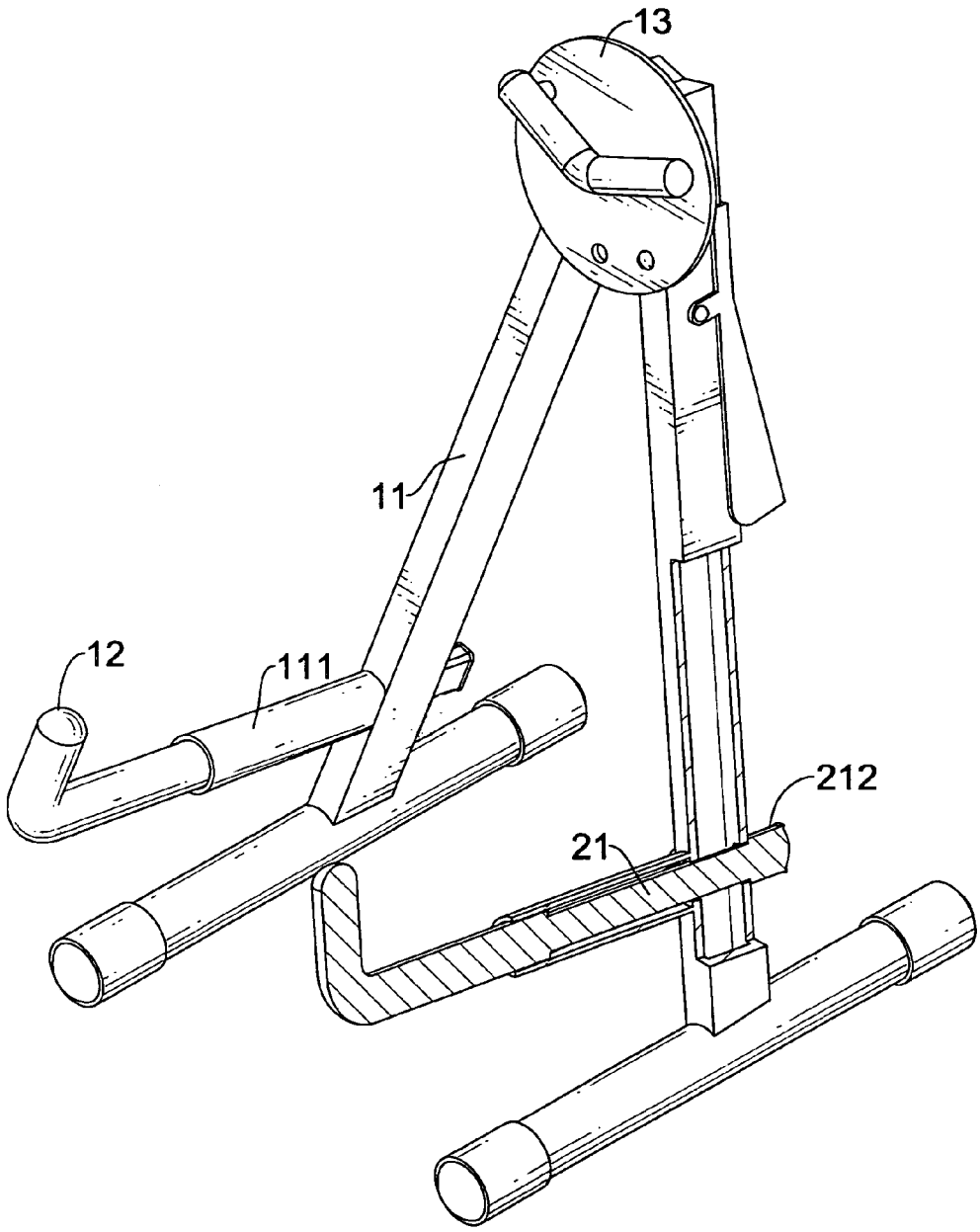
FIG. 1A is a perspective view showing the overall appearance of the first embodiment of the instrument support of the present invention.
Figure 1B:
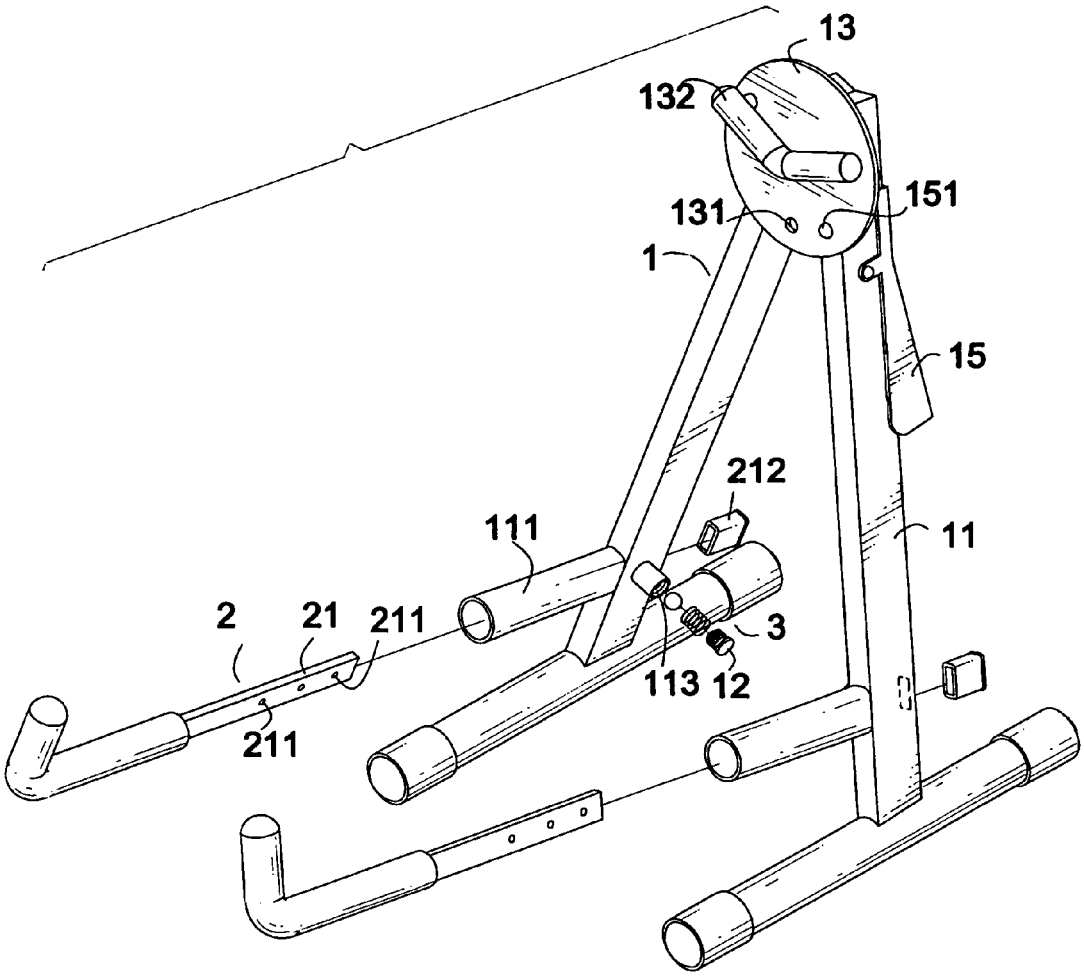
FIG. 1B is an exploded perspective view of the second embodiment of the instrument support of the present invention.

With reference to FIGS. 1A, 1B, it is noted that the instrument support in accordance with the present invention has a bracket (1) and two forks (2).

The bracket (1) is able to stand by itself on a surface and has two legs (11), a disk (13) and a handle (15) in the preferred embodiment of the present invention.

One of the legs (11) is securely fixed to the disk (13) and the other leg (11) is pivotally connected to the disk (13). The handle (15) is pivotally connected to one of the two legs (11) and has an extension (151) extending from a distal end of the handle (15) to extend into a corresponding one of multiple positioning holes (131) in the disk (13). Therefore, when the handle (15) is pressed (pivoted) to allow the extension (151) to leave the restriction of the corresponding positioning hole (131) of the disk (13), the two legs (11) are able to move with respect to one another. Furthermore, the disk (13) has a cushion (132) formed on a front face of the disk (13) to be in engagement with an instrument to function as a damper. However, as the aforementioned cushion (132) is conventional in the art, detailed description thereof is thus omitted.

Each leg (11) has a hollow tube (111) extending outward therefrom and a through hole (113) defined in a side face of the leg (11) to communicate with an interior of the tube (111). A spring-ball combination (3) is provided in the through hole (113) so that the ball of the spring-ball combination (3) is able to selectively protrude from the through hole (113).

Each fork (2) is movably received in a corresponding one of the hollow tubes (111) and has an adjustable rod (21) integrally formed with the fork (2) and having recesses (211) defined in a side face of the adjustable rod (21) to correspond to a ball of the spring-ball combination (3).

Figure 1C:
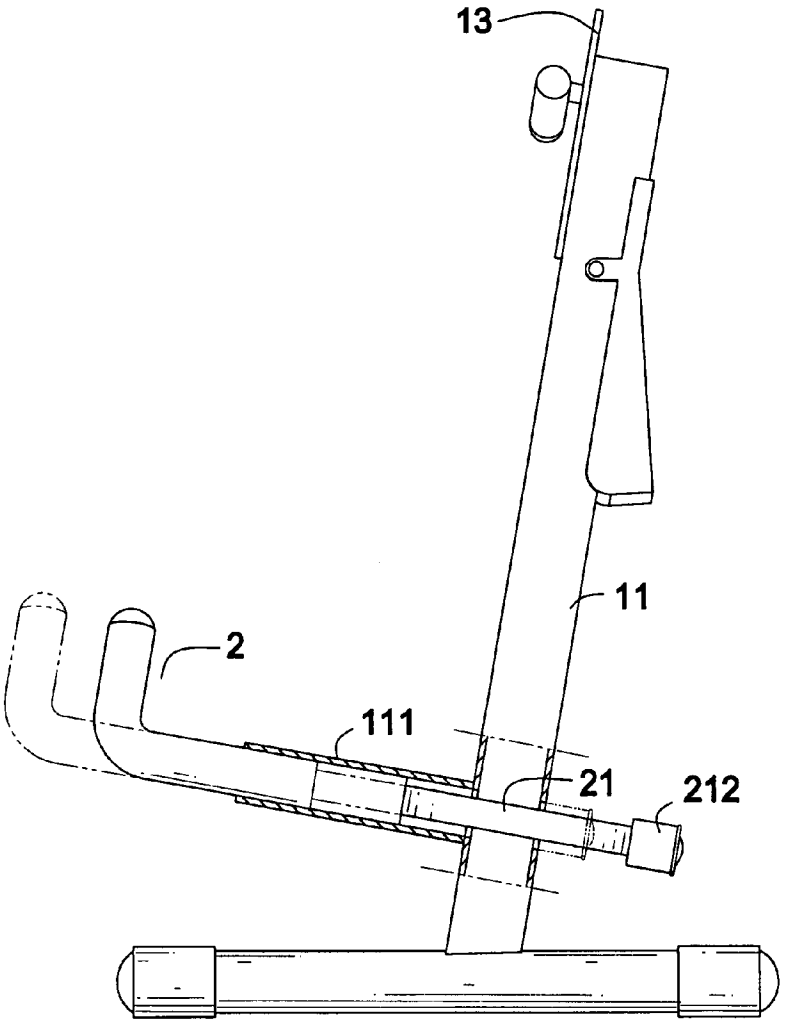
FIG. 1C is a schematic side view showing the adjustment of the fork relative to the hollow tube.
Figure 2:
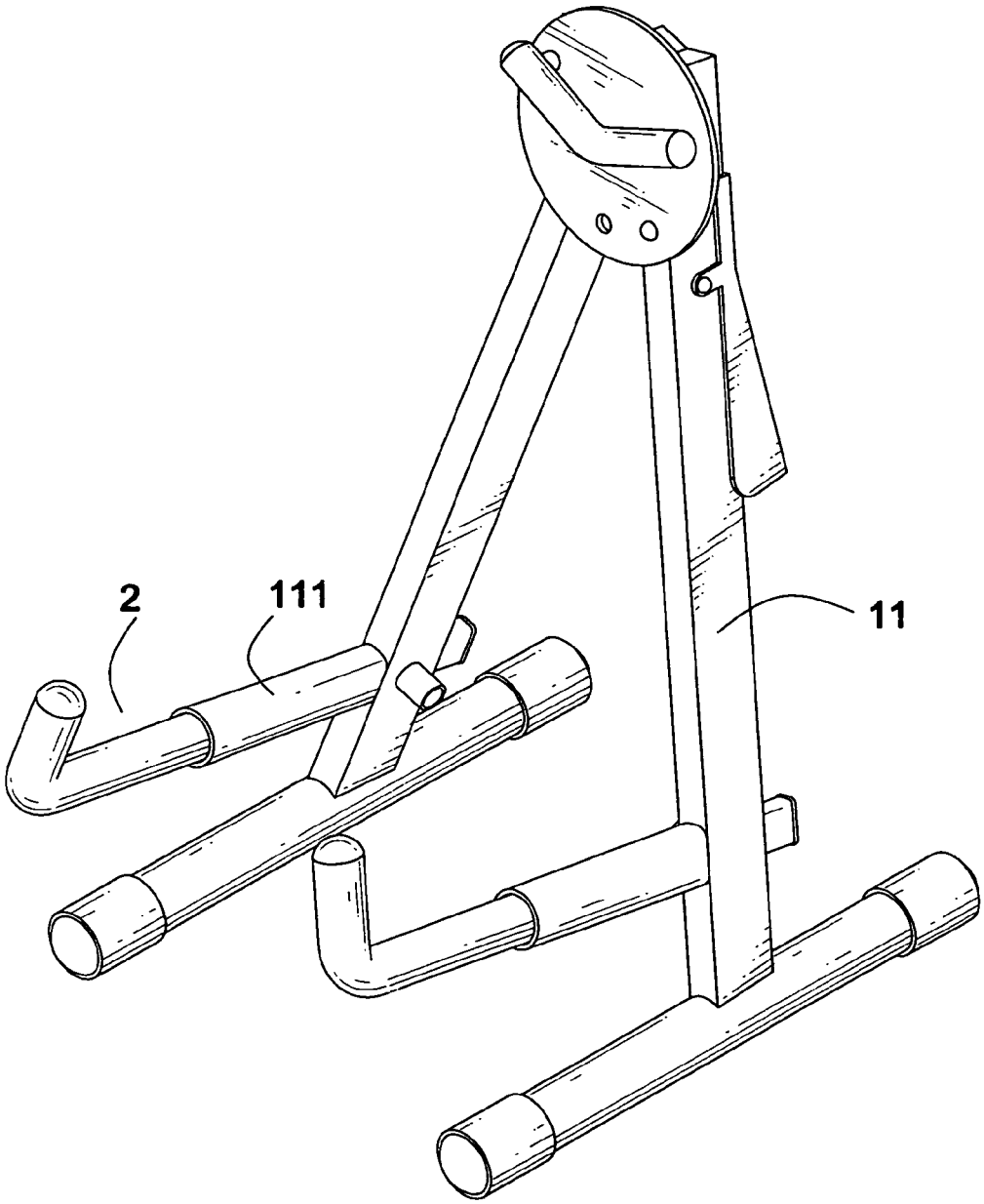
FIG. 2 is a perspective view of the instrument support of the present invention.

With reference to FIG. 2 and still using FIG. 1 for reference, it is noted that after assembly of the present invention, the adjustable rod (21) is directly received in the corresponding tube (111) and the spring-ball combination (3) is received in the through hole (113) and secured by a cap (12).

Figure 3:
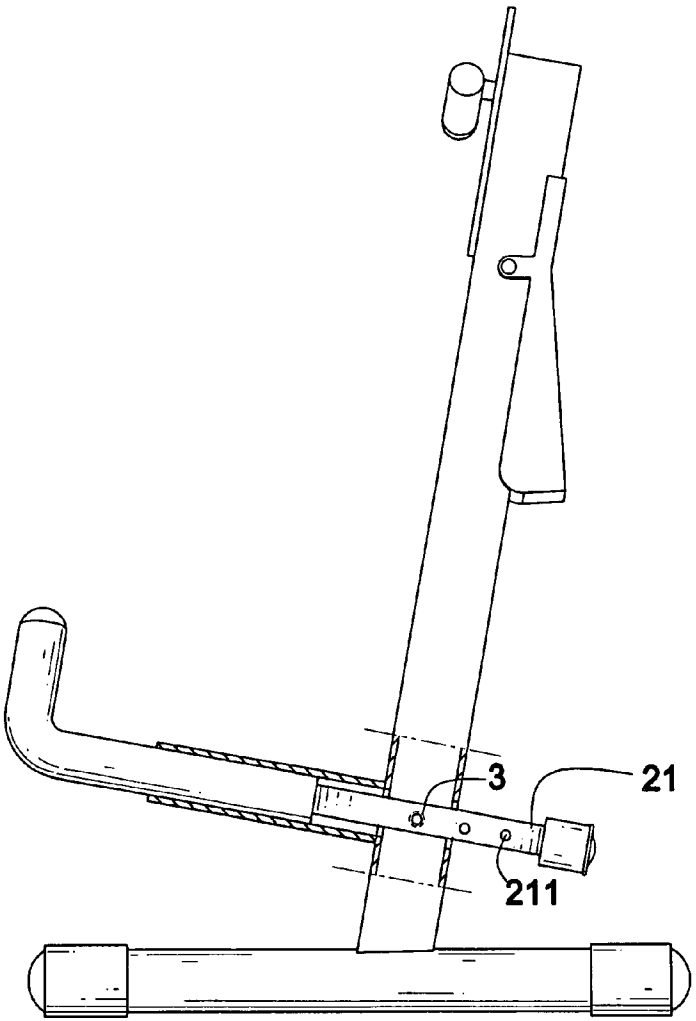
FIGS. 3 and 4 are schematic views showing the operation of the present invention.
Figure 4:
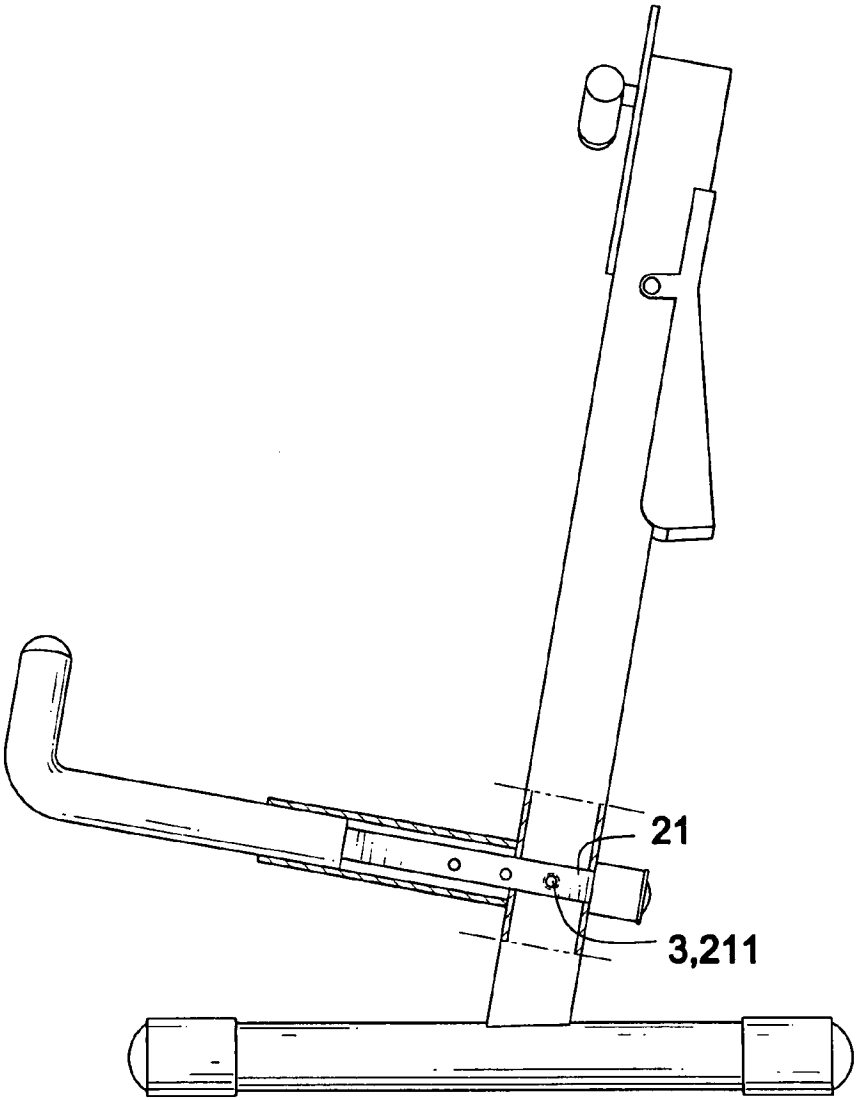
Figure 5:
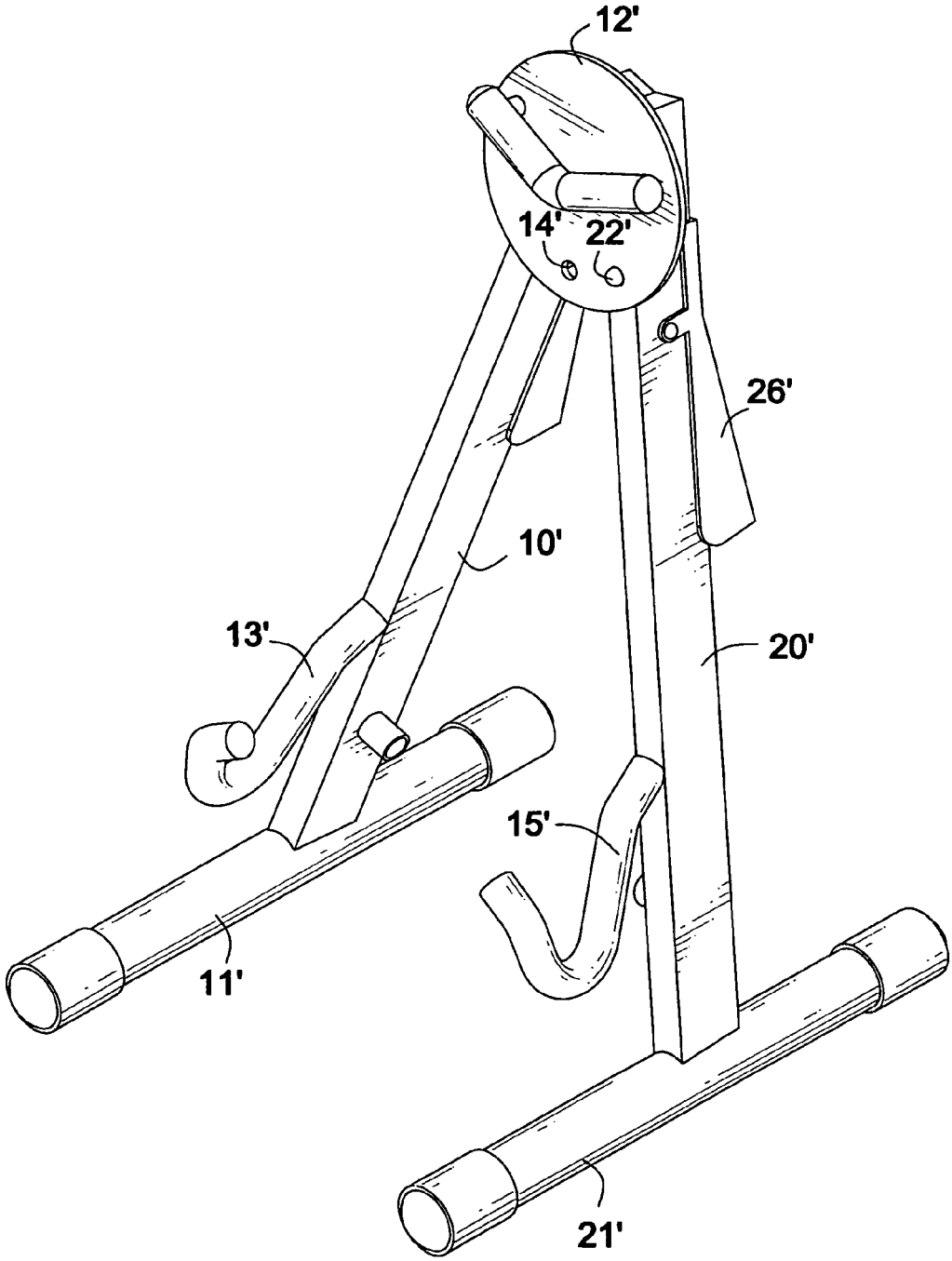
FIG. 5 is a perspective view of a conventional instrument support.
Figure 6:
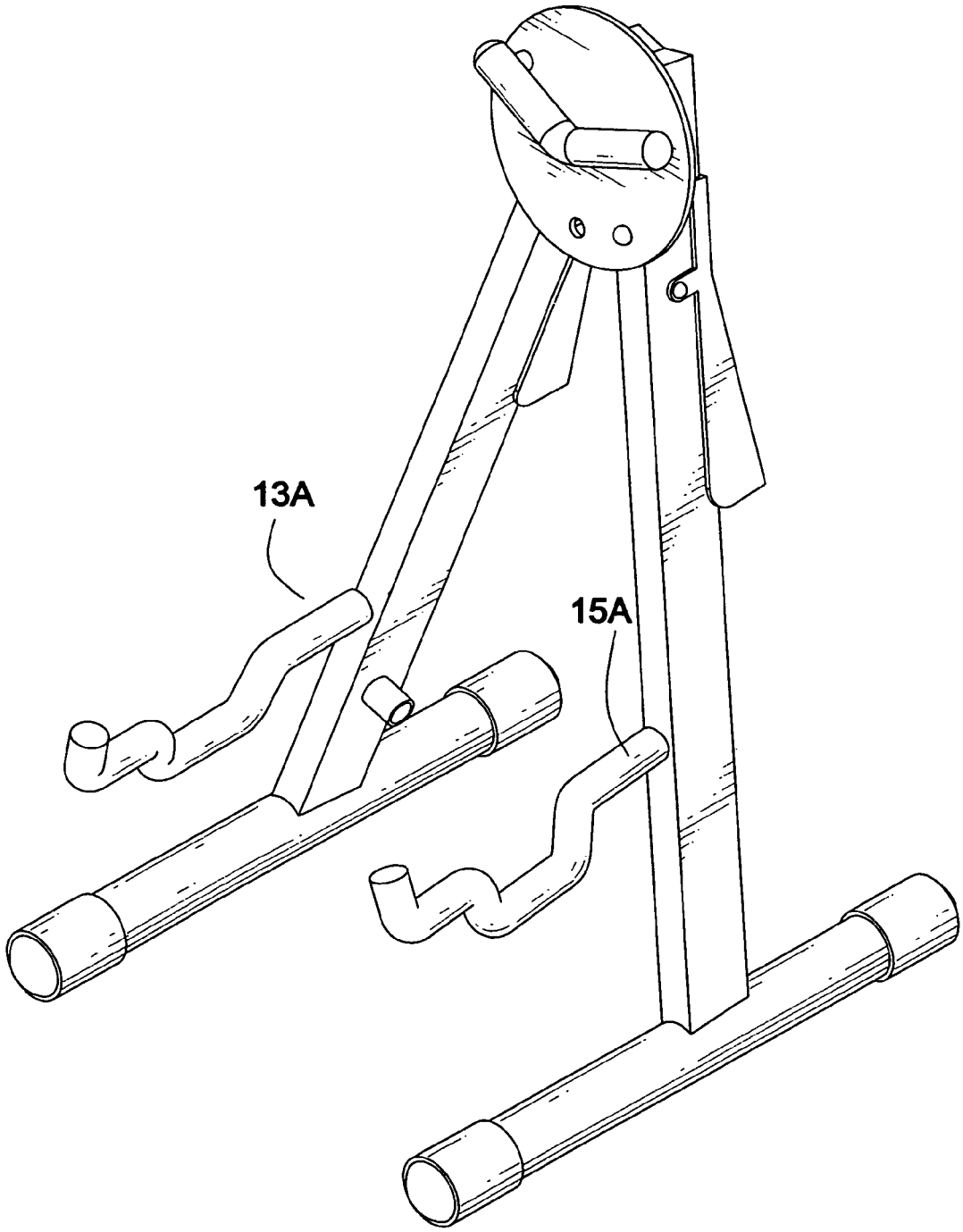
FIG. 6 is a perspective view of a different conventional instrument support.

With reference to FIGS. 3 and 4, it is noted that the operator is able to move the forks (2) relative to the bracket (1) to have the ball of the spring-ball combination (3) to be engageable in different recesses. After the adjustment of the projection length of the two forks (2) relative to the bracket (1), instruments of different thickness are able to be securely supported and clamped by the instrument support of the present invention.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. In an instrument support having a bracket provided with a first leg, a second leg, a disk and two forks, the first leg being securely and fixedly connected to the disk and the second leg being pivotally connected to the disk and having a handle pivotally connected to the second leg to allow an extension which is integrally formed on a distal end of the handle to correspond to one of positioning holes in the disk to allow the first leg and the second leg to move with respect to one another, wherein the improvement comprises:

each fork is movably and respectively received in the first and second legs and has an adjustable rod integrally formed with the fork to extend through a corresponding one of the first leg and the second leg so that movement of the two forks provide adaptation to thickness of different instruments, wherein each of the first leg and the second leg has a through hole defined in a side face of the first leg and second leg to communicate with an interior of the first leg and second leg to receive therein a spring-ball combination, and each adjustable rod has recesses defined in a side face of the adjustable rod to correspond to the spring-ball combination.

2. The instrument support as claimed in claim 1, wherein each of the first leg and second leg has a tube and respectively extending from the first leg and the second leg to movably receive therein a corresponding one of the two forks.

3. In an instrument support having a bracket provided with a first leg, a second leg, a disk and two forks, the first leg being securely and fixedly connected to the disk and the second leg being pivotally connected to the disk and having a handle pivotally connected to the disk and having a handle pivotally connected to the second leg to allow an extension which is integrally formed on a distal end of the handle to correspond to one of positioning holes in the disk to allow the first leg and the second leg to move with respect to one another, wherein the improvement comprises:

each fork is movably and respectively received in the first and second legs and has an adjustable rod integrally formed with the fork to extend through a corresponding one of the first leg and the second leg so that movement of the two forks provide adaptation to thickness of different instruments, wherein each of the first leg and the second leg has a through hole defined in a side face of the first leg and second leg to communicate with an interior of the first legal and second leg to receive therein a spring-ball combination, each adjustable rod has recesses defined in a side face of the adjustable rod to correspond to the spring-ball combination, and each of the first leg and second leg has a tube respectively extending from the first leg and the second leg to movably receive therein a corresponding one of the two forks.

* * * * *